US010372086B2

(12) United States Patent
Kim

(10) Patent No.: US 10,372,086 B2
(45) Date of Patent: Aug. 6, 2019

(54) SMART WATCH HAVING DISPLAY, COLOR OF WHICH CHANGES ACCORDING TO STATE OF USER

(71) Applicant: HANCOM, INC., Seongnam-si, Gyeonggi-do (KR)

(72) Inventor: Sang Cheol Kim, Namyangju-si (KR)

(73) Assignee: HANCOM, INC., Seongnam-si, Gyeonggi-do (KR)

( * ) Notice: Subject to any disclaimer, the term of this patent is extended or adjusted under 35 U.S.C. 154(b) by 0 days.

(21) Appl. No.: 15/771,092

(22) PCT Filed: Oct. 20, 2016

(86) PCT No.: PCT/KR2016/011850
§ 371 (c)(1),
(2) Date: Apr. 26, 2018

(87) PCT Pub. No.: WO2017/073959
PCT Pub. Date: May 4, 2017

(65) Prior Publication Data

US 2018/0364649 A1 Dec. 20, 2018

(30) Foreign Application Priority Data

Oct. 28, 2015 (KR) ..... 10-2015-0150567

(51) Int. Cl.
*G04G 21/02* (2010.01)
*G04G 9/00* (2006.01)
*G04G 21/06* (2010.01)

(52) U.S. Cl.
CPC ..... *G04G 21/025* (2013.01); *G04G 9/00* (2013.01); *G04G 9/0064* (2013.01); *G04G 21/02* (2013.01); *G04G 21/06* (2013.01)

(58) Field of Classification Search
CPC ..... G04G 21/025; G04G 9/00; G04G 9/0064; G04G 21/02; G04G 21/06
(Continued)

(56) References Cited

U.S. PATENT DOCUMENTS

2008/0004510 A1 1/2008 Tanzawa et al.
2009/0002178 A1* 1/2009 Guday ..... A61B 5/0002 340/573.1
(Continued)

FOREIGN PATENT DOCUMENTS

JP 2007-279020 A 10/2007
KR 10-1349767 B1 1/2014
(Continued)

OTHER PUBLICATIONS

International Search Report for PCT/KR2016/011850 dated Dec. 30, 2016 from Korean Intellectual Property Office.

*Primary Examiner* — Jack K Wang
(74) *Attorney, Agent, or Firm* — Revolution IP, PLLC

(57) ABSTRACT

A smart watch having a display changing in color according to a state of a user, the smart watch includes: an output unit having a display unit; a sensor unit collecting state information for a measurement target associated with a user or around the user; and a control unit comparing the collected state information with state combination information stored in advance, selecting one piece of combination information that corresponds to the state information from among the state combination information, and controlling the output unit so as to output a displayed color matching the selected combination information.

10 Claims, 3 Drawing Sheets

(58) Field of Classification Search
USPC ..... 340/573.1
See application file for complete search history.

(56) References Cited

U.S. PATENT DOCUMENTS

| | | | | |
|---|---|---|---|---|
| 2011/0245633 | A1 | 10/2011 | Goldberg et al. | |
| 2014/0372551 | A1* | 12/2014 | Fleck | H04W 72/04 709/213 |
| 2015/0335282 | A1 | 11/2015 | Lee | |
| 2016/0357282 | A1* | 12/2016 | Block | G06F 1/163 |
| 2017/0003845 | A1* | 1/2017 | Karsten | G06F 19/3418 |

FOREIGN PATENT DOCUMENTS

| | | | |
|---|---|---|---|
| KR | 10-1354625 | B1 | 1/2014 |
| KR | 10-1525330 | B1 | 6/2015 |

* cited by examiner

【FIG. 1】
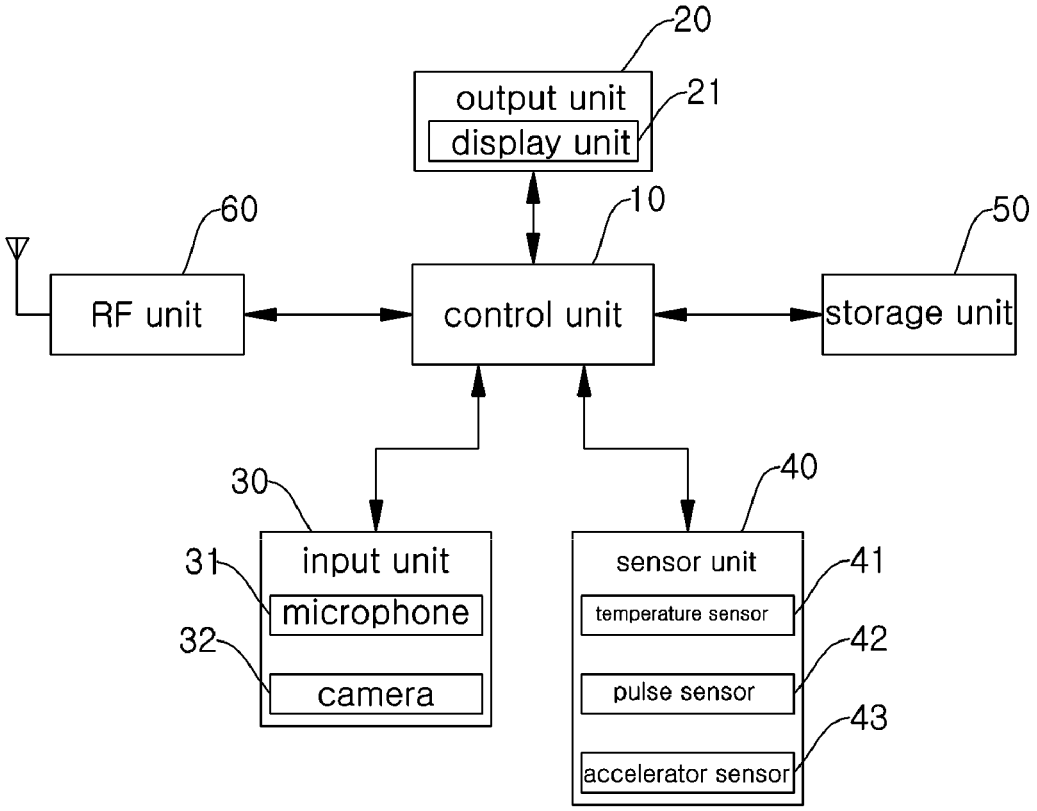

【FIG. 2】

| measurement target | | state combination | displayed color |
|---|---|---|---|
| face color | red(a1) | a1b1c1d1e1f1g1h1 | blue |
| | normal(a2) | a1b1c1d1e1f1g1h2 | dark blue |
| | pale(a3) | a1b1c1d1e1f1g1h3 | red |
| pupil shape | enlarged(b1) | a1b1c1d1e1f1g2h1 | dark red |
| | reduced(b2) | a1b1c1d1e1f1g2h2 | light red |
| pulse | fast(c1) | . | . |
| | normal(c2) | . | . |
| | slow(c3) | . | .. |
| body | high(d1) | . | |
| | normal(d2) | . | . |
| | low(d3) | . | . |
| voice | excited(e1) | . | . |
| | calm(e2) | . | . |
| ambient brightness | bright(f1) | . | . |
| | normal(f2) | . | . |
| | dark(f3) | . | . |
| ambient temperature | high(g1) | . | . |
| | normal(g2) | . | . |
| | lpw(g3) | . | . |
| activity | fast movement(h1) | . | . |
| | slow movement(h2) | . | . |
| | no movement(h3) | . | . |

【FIG. 3】
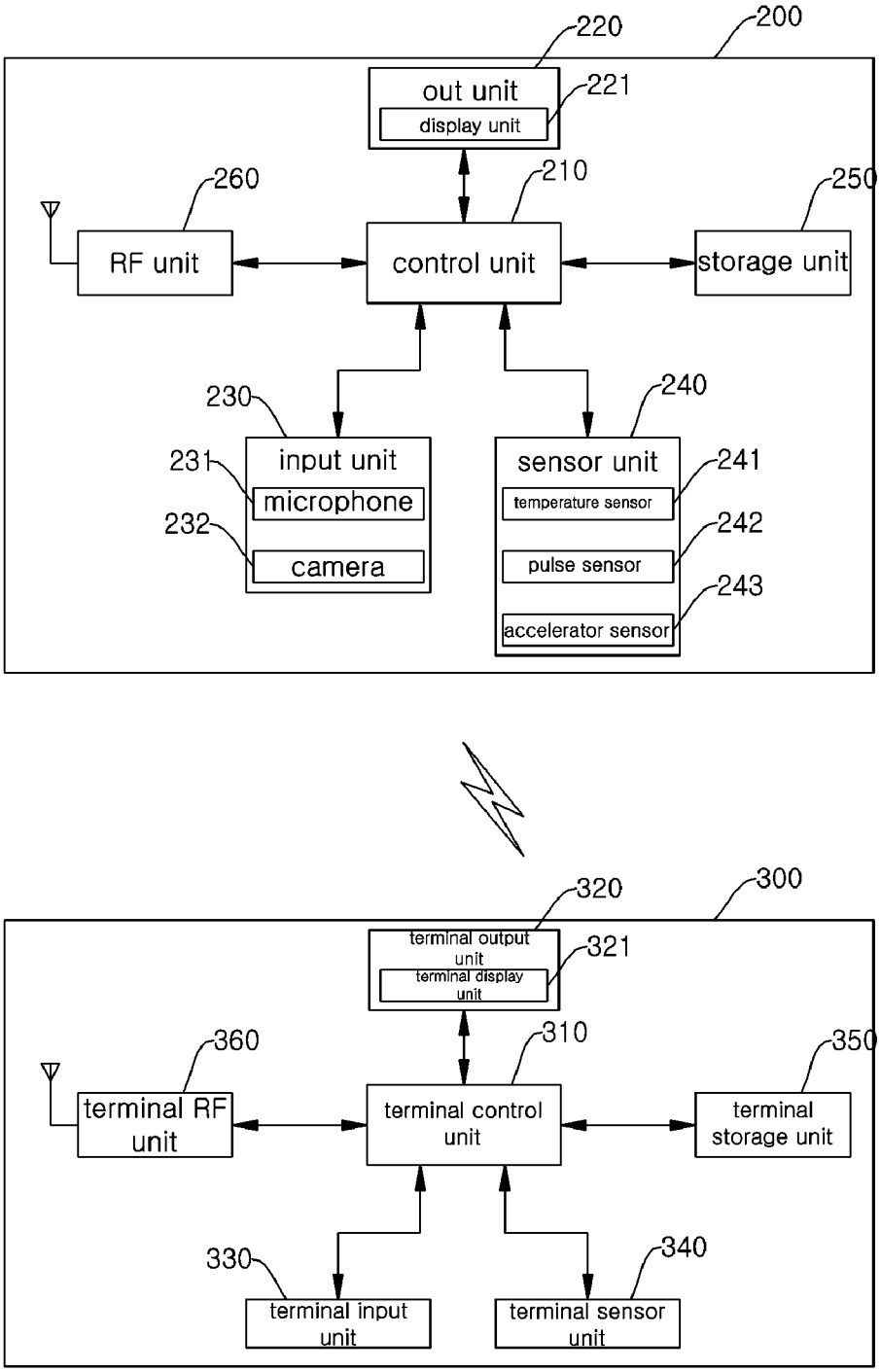

SMART WATCH HAVING DISPLAY, COLOR OF WHICH CHANGES ACCORDING TO STATE OF USER

TECHNICAL FIELD

The present invention relates to a smart watch and, more particularly, to a smart watch having a display changing in color according to the state of a user, the smart watch measuring the mood or state of the user in various methods and changing a displayed color in a wearable auxiliary device according to the mood of the user, thereby allowing the user to express individuality via the smart watch and diverting the mood of the user through a change in the displayed color of the smart watch.

BACKGROUND ART

In recent years, mobile terminal devices have become devices that people most often come into contact with, carry, and use. Such mobile terminals are already functionally expanded beyond the function of a landline telephone, which has merely been used for a call, and are used as functional devices that provide specific functions according to a need and purpose of the user, and are also used as amusement equipment that has an important role in the leisure industry.

With this tendency, the functions of the mobile terminal are becoming more complicated and various, and the size of the mobile terminal is becoming larger. As a result, portability of the mobile terminal is gradually deteriorating. Accordingly, the use of an auxiliary terminal that allows some simple functions of the functions of the mobile terminal to be performed is increasing.

The auxiliary terminal is generally used in a form such as a wristwatch, spectacles, and a necklace. Especially, the smart watch in a form of a wrist watch is most commonly used among various forms. The smart watch is frequently exposed to the user as compared with the mobile terminal due to the characteristics thereof. Generally, the mobile terminal is stored in a pocket or a bag while moving, whereas the smart watch is used while being worn on the body, whereby the user can frequently check the smart watch. Particularly, the smart watch can be referred to as a device that the user checks most frequently among other wearable auxiliary terminals.

However, even if the auxiliary terminal has excellent design and usability, because the user frequently comes in contact therewith, he/she can become easily bored with the design of the auxiliary terminal. Also, due to the characteristics of mass-produced products, it is difficult for the user express his/her own characteristics via the watch.

DISCLOSURE

Technical Problem

Accordingly, the present invention has been made keeping in mind the above problems occurring in the prior art, and an object of the present invention is to provide a smart watch having a display changing in color according to the state of a user, in which the mood or state of the user is measured by various methods and a wearable auxiliary device is allowed to change a displayed color thereof according to the mood of the user, thereby allowing the user to express individuality via the smart watch and diverting the mood of the user through a change in the displayed color of the smart watch.

Technical Solution

In order to accomplish the above object, the present invention provides a smart watch having a display changing in color according to a state of a user, the smart watch including an output unit having a display unit; a sensor unit collecting state information for a measurement target associated with a user or around the user; and a control unit comparing the collected state information with state combination information stored in advance, selecting one piece of combination information that corresponds to the state information from among the state combination information, and controlling the output unit so as to output a displayed color matching the selected combination information.

The sensor unit may be configured to include at least one of a temperature sensor, a pulse sensor, a blood pressure sensor, an accelerator sensor, a GPS sensor, a gyro sensor, and an optical sensor; and an input device including a camera or a microphone.

The displayed color may be a screen color of the display unit output via the display unit in a standby status or a theme color of an icon or an image output via the display unit while a function is performed.

The collected state information is provided such that a level thereof is determined according to segmented levels determined for each of the measurement targets, and the information for each of the measurement targets having the determined level is combined.

The present invention further includes a storage unit, in which a reference value predetermined for each of the measurement targets is stored in the storage unit to determine the level according to the segmented levels, and the control unit compares the reference value with the state information to determine the level for the measured value of the measurement target.

The state combination information may include a plurality of pieces of state combination written by combining the segmented levels of the measurement targets, and the displayed color determined for each of the plurality of pieces of state combination.

The control unit may compare the state information obtained by combining the determined levels with the plurality of pieces of state information to search for the matching state combination, and control the output unit to output a displayed color that is stored to correspond to the state combination found through the searching.

The smart watch is configured to include an RF unit for performing communication with a mobile terminal of a master device, and performs a part of functions of the mobile terminal instead of the mobile terminal, and is worn on a user's body part.

The state information is collected from at least one of the smart watch and the mobile terminal.

The determination of the segmented level for the state information and the determination of the displayed color are performed by the smart watch or the mobile terminal.

The mobile terminal controls an output unit thereof to output the determined displayed color.

Advantageous Effects

According to the present invention, the smart watch having a display changing in color according to the mood of a user is configured such that the mood or state of the user is measured by various methods, and a displayed color in a wearable auxiliary device is caused to change according to the mood of the user, thereby allowing the user to express individuality via the smart watch and also diverting the mood of the user through a change in the displayed color of the smart watch.

DESCRIPTION OF DRAWINGS

FIG. 1 is an exemplary diagram showing a configuration of a smart watch according to a first embodiment of the present invention.

FIG. 2 is an exemplary diagram illustrating a procedure of determining a displayed color according the state of a user according to a first embodiment of the present invention.

FIG. 3 is an exemplary diagram illustrating a configuration of a smart watch having a display changing in color according to the state of a user according to a second embodiment of the present invention.

BEST MODE

Hereinafter, preferred embodiments of the present invention will be described with reference to the accompanying drawings so that those skilled in the art can easily carry out the present invention. It should be noted that the same reference numerals denote the same elements throughout the accompanying drawings. In the following description of the present invention, detailed description of known functions and configurations incorporated herein will be omitted when it may make the subject matter of the present invention unclear, certain features shown in the drawings are to be enlarged or reduced or simplified for ease of explanation, and the drawings and their components are not necessarily drawn to scale. However, those skilled in the art will readily understand these details.

In addition, although the smart watch is representatively disclosed in the present invention, the technique of the present invention can be applied to a wearable auxiliary device based on the present invention, which is within the scope that can be simply inferred by a person skilled in the art.

FIG. 1 is an exemplary diagram showing a configuration of a smart watch according to a first embodiment of the present invention.

Referring to FIG. 1, the smart watch according to a first embodiment of the present invention is configured to include a control unit 10, an output unit 20, an input unit 30, a sensor unit 40, a storage unit 50, and an RF unit 60.

The control unit 10 controls the output unit 20, the input unit 30, the sensor unit 40, the storage unit 50, and the RF unit 60, processes data therefrom so that the smart watch has a role of auxiliary device to the mobile terminal, and processes sensing results from the input unit 30 and the sensor unit 40 so that the output unit 20 is controlled to cause the displayed color of the smart watch to be changed.

Specifically, the control unit 10 analyzes the state of the user using data input from the input unit 30 or the sensor unit 40 and determines the displayed color according to the state of the user according to the analysis result, thereby causing the output unit 20 of the smart watch to express the displayed color. More specifically, the control unit 10 collects information sensed from the input unit 30 or the sensor unit 40, and analyzes whether the user feels anger, excitement, or motivation due to exercise, depression or boredom, good feelings, or another state. Then, the control unit 10 compares the analyzed state of the user with the displayed color data stored in the storage unit 50 to determine the displayed color.

Herein, the control unit 10 may determine the displayed color to cause the state of the user to be changed using the displayed color data, or determine the displayed color to sustain and improve the current state as long as possible. Specifically, when the user needs to calm down, such as when he or she feels anger, or excessive excitement, a cool color such as purple and a calming color such as blue or green may be determined as the displayed color. Meanwhile, when the user is in a good or pleasant state, the control unit 10 may select the displayed color to be yellow or red in order to longer sustain and further stimulate the state. The displayed color for each state of the user may be stored to be corresponded to the displayed color data.

Meanwhile, the control unit 10 may control the output unit 20 to express the displayed color that is determined. Specifically, when a display unit 21 of the output unit 20 is in a standby status, the control unit 10 allows the displayed color to be output via the display unit 21. When the display unit 21 is in an active state, that is, when performing a specific function, the display unit 21 expresses an icon of the corresponding function and at this time, the displayed color may be provided in a theme form. That is, when the user wants to view a text message, the displayed color is caused to be output through the output unit 20 by outputting the text message using the displayed color of the background of the text message or a color of the text message. The procedure of analyzing the state of the user in the control unit 10 will be described below.

The output unit 20 outputs results obtained by performing the function of the smart watch and the displayed color according to the control of the control unit 10. To this end, the output unit 20 includes the display unit 21 for displaying an image, in which the displayed color is output through the display unit 21. In addition, the output unit 20 may include a speaker for outputting sound and a motor for generating vibration, but such a configuration is omitted in FIG. 1.

The input unit 30 receives various commands or information for realizing the function of the smart watch. Specifically, the input unit 30 is configured to include a touch input unit to which a user's command for executing the function of the smart watch are input, a microphone 31 to which a voice command, a call, and other sounds are input, and a camera through which an image is input, in which the touch input unit may be provided in the form of a touch screen coupled with the display unit 21. In particular, the camera 32 and the microphone 31 included in the input unit may be means for collecting information of the user. That is, a face of the user may be recognized through the camera 32, so that a change in the face color, blushing, and a change in facial expression may be input, and if necessary, the image of the surrounding environment may be taken and transferred to the control unit 10. In the case of the microphone 31, the voice of the user may be received and then transferred to the control unit 10. In other words, the mood or state of the user may be determined by analyzing information such as user's facial expression, skin tone, and pupil shape that is input through the camera 32 of the input unit 30 and user's voice that is input by the microphone 31, whereby the displayed color may be determined.

The sensor unit 40 collects information for executing general functions of the smart watch and then transfers the collected information to the control unit. In particular, the sensor unit 40 collects information for determining the state of the user and transfers the collected information to the control unit 10. To this end, the sensor unit 40 is configured to include a temperature sensor 41, a pulse sensor 42, and an accelerator sensor 43.

The temperature sensor 41 measures the temperature of the user's body and transfers it to the control unit 10. The control unit 10 analyzes the state of the user by using the user's body temperature together with other information. The pulse sensor 42 measures the pulse of the user and transfers it to the control unit 10. The acceleration sensor 43 measures an acceleration applied to the smart watch and transfers the measured acceleration to the control unit 10. The procedures of determining the status of the user by using the information collected by each of the sensors and the input unit 30 will be described in more detail below.

The storage unit 50 stores program data for operating the smart watch and program data executed by the smart watch and, in particular, displayed color data for determining the state of the user and determining the display color. The storage unit 50 receives and stores information written from the input unit 30 and the sensor unit 40 and collected in the control unit 10, and provides the information according to a request from the control unit 10, whereby the control unit 10 may analyze the state of the user.

The RF unit 60 performs communication with the mobile terminal and a Bluetooth device to drive the smart watch.

FIG. 2 is an exemplary diagram illustrating a procedure of determining the displayed color according the state of a user according to a first embodiment of the present invention.

Referring to FIG. 2, the smart watch of the present invention collects information on the state of the user, analyzes the information, determines the state of the user, and then changes and provides the displayed color of the smart watch or the display theme according to the determination result, whereby the smart watch of the present invention has a role of sustaining the user's good mood or alleviating the bad mood of the user within a short time. Along with this, the displayed color is frequently changed so that a new feeling may be provided for a smart watch that a user may become easily bored with, whereby the user may develop an affinity for the smart watch.

To this end, the smart watch of the present invention may determine the state of the user as accurately as possible based on the information input through the input unit 30 and the sensor unit 40. Then, the displayed color of the smart watch is determined based on the determination result, whereby the displayed screen color may be changed for an idle time or the theme color may be changed while the function is performed.

To this end, as shown in FIG. 1, the control unit determines the state of the user using the state information of the user collected through the input unit 30 or the sensor unit 40, determines the displayed color (displayed screen color or theme color) according to the determination result, and then controls the output unit 220.

The present invention is provided to measure various states for the user to determine the displayed color according to the state of the user, and utilize state information of the user collected through the measurement. Specifically, items such as face color, pupil shape, pulse, body temperature, voice, the ambient brightness, the ambient temperature, and activity are used as the measurement targets.

The measurement target such as face color, pupil shape, and the ambient brightness may be measured using a camera configured in the smart watch and a light sensor module configured in the camera, and the body temperature and the ambient temperature may be measured using a temperature sensor configured in the smart watch. In addition, the pulse may be measured using a pulse sensor, and the activity may be measured using an acceleration sensor and a GPS sensor. In addition, if other sensors such as a gyro sensor are configured in the smart watch, they may be used for measuring the state of the user.

The smart watch according to the present invention may measure various measurement targets and thus accurately measure and analyze the state of the user using various kinds of sensors 40 and input devices, and accordingly the optimum display color may be determined and output, thereby improving functional or aesthetic effects.

More specifically, in the present invention, as shown in FIG. 2, a lookup table is written and stored in which indicators of the measurement targets are classified and the state combinations obtained by combining the indicators of each measurement target are configured, and the displayed color for each of the state combinations is determined. The state combinations are obtained by combining a plurality of measurement objects measured for a user, and are configured in such a manner that the control unit may recognize the state capable of being expected by measuring measurement objects among states that the user may feel.

Such state combination is necessary because it is difficult to accurately predict the state of the user via simple indicator measurement. Therefore, according to the present invention, various kinds of measurement objects are measured to form the state combinations, and the displayed color according to the state combinations is determined, whereby quick processing may be performed.

Specifically, when measuring the measurement target, each of the measured values is divided into grades to segment the state combinations. For example, the face color is divided into red (a1), normal (a2), and pale (a3), the pupil shape is divided into enlarged (b1) and reduced (b2), the pulse is divided into fast (c1), normal (c2), and slow (c3), the body temperature is divided into high (d1), normal (d2), and low (d3), the voice is divided into excited (e1) and calm (e2), the ambient light is divided into bright (f1), normal (f2), and dark (f3), the ambient temperature is high (g1), normal (f2), and low (f3), and the activity is fast movement (h1), slow movement (h2), and no movement (h3). In this way, it is possible to accurately predict the user's state by segmenting the measured values of the measurement target and combining the segmented values.

For example, when analyzing the state of a user depending on only any one of the measurement targets, the user's state may be erroneously determined and thus the displayed color may be erroneously presented, thereby degrading functional and aesthetic intensions. For example, when the user's state is determined only by the user's body temperature, it is difficult to confirm whether the user's body temperature is increased due to exercise, high room temperature, illness, or anger. Generally, in most cases, it is possible to calm the user by providing a blue or green color, but in the case of a rise in body temperature even in a good state, providing the blue or green color will result in disturbing the user from continuing to feel good.

Therefore, according to the present invention, various indicators that may be measured from the user are measured, and each of the measured indicators is divided into grades, whereby it is possible to accurately analyze the state of the user depending on combination of each grade even under a similar state. Then, the displayed color determined depending on each state is output, thereby improving functional and aesthetic effects.

The control unit 10 classifies information input from each sensor of the input unit 30 or the sensor unit 40 according to the predetermined reference to segment the measured value. That is, when data obtained by capturing a face via a camera is transferred, the face color is compared with a previously prepared image to determine a grade of the data. Likewise, in the case of the pupil shape, it is also checked whether the pupil is enlarged or not by comparing an image captured in advance with data provided through the camera. In this manner, the control unit 10 compares the reference value stored in the storage unit 250 in advance with the measured value input through the input unit 30 and the sensor unit 40, and then selects a level suitable for the current state from among the segmented levels.

Meanwhile, the storage unit 250 stores the state combinations obtained by combining different types of measurement objects for each segmented level and the displayed color determined for each of the state combinations. The state combination is compared with a combination of segmented levels of each measurement object determined by the control unit 210 via the measured value. That is, the control unit 210 searches the state combinations for the combination of segmented levels of the measurement target confirms the displayed color determined in the state combination found through the searching of the control unit 10, and outputs the corresponding displayed color via the output unit 220.

Specifically, as shown in FIG. 2, the state combination is represented, such as a1b1c1d1e1f1g1h1 indicating a state in which the face color is red, the pupil is enlarged, the pulse is fast, the body temperature is high, the voice is excited, the ambient light is bright, the ambient temperature is high, and the user's activity is fast movement. Then, the displayed color is determined as a state in which the user exercises outdoors, so that the displayed color may be determined as a green color that may allow the tension of the exercise to be reduced. In this method, the state combinations are obtained by combining all the segmented levels for each measurement target and the displayed color for each state combination is determined.

As described above, the states for each measurement target states are segmented and determined, and any one measurement target is not used but a plurality of measurement targets are considered in combination, whereby the state of the user may be accurately determined, and an optimal display color may be provided, and thus the effect of the displayed color may be improved.

FIG. 3 is an exemplary diagram illustrating a configuration of a smart watch having a display changing in color according to the state of a user according to a second embodiment of the present invention. In the following description of the second embodiment of the present invention, detailed descriptions of the same configurations as those of the above-described first embodiment, and configurations that may be easily changed by the first embodiment are omitted.

The smart watch according to the second embodiment of the present invention is configured to include a smart watch 200 and a mobile terminal 300 serving as a master terminal of the smart watch 200. The smart watch is configured to include a control unit 210, an output unit 220, an input unit 230, a sensor unit 240, a storage unit 250, and a RF unit 260. Further, the mobile terminal 300 is configured to include a terminal control unit 310, a terminal output unit 320, a terminal input unit 330, a terminal sensor unit 340, a terminal storage unit 350, and a terminal RF unit 360.

The first embodiment described above is provided such that the state information determined by measuring the state of the user is compared with predetermined state combinations to search the state combinations for the state combination that is the same as the current user state, whereby the displayed color determined for the corresponding state combination is applied to a displayed color of the smart watch. Similar to the first embodiment, the second embodiment of the present invention is provided such that the state of the user is analyzed, the state is compared with the state combination determined in advance to determine the display color, and then the determined display color is applied to the display color of the smart watch.

However, the second embodiment differs from the first embodiment in that the procedure of measuring and analyzing the current state of the user is performed via communication of the smart watch 200 and the mobile terminal 300. In addition, the smart watch 200 and the mobile terminal 300 may interchange measurement data obtained by measuring the state of the user and the analysis result thereof, and the determination of the display color is performed by the mobile terminal 300.

More specifically, as shown in FIG. 3, the smart watch 200 and the portable terminal 300 is configured to include a control unit 210 and a terminal control unit 310, respectively, and, in addition, an input unit 230 and an terminal input unit 330, and a sensor unit 240 and a terminal sensor unit 340, respectively. That is, the state measurement of the user may be performed in both the smart watch 200 and the mobile terminal 300. Particularly, the smart watch 200 and the mobile terminal 300 may measure the same measurement target and compare the measured values thereof, but may combine and use the information that is measured independently or received from each other when configurations of the respective input units 230 and 330 and the respective sensor units 240 and 340 of the smart watch 200 and the mobile terminal 300 are different from each other.

That is, the smart watch 200 has a camera and a microphone configured in the input unit 230 and only a temperature sensor configured in the sensor unit 240, while the mobile terminal 300 has a camera and a microphone, and a GPS sensor, an acceleration sensor, and a gyro sensor configured in terminal sensor unit 340. In this case, the data measured by each sensor of the smart watch 200 and the mobile terminal 300 may be used for analyzing the state of the user. In particular, when devices such as a microphone and a camera are configured in both the smart watch 200 and the mobile terminal 300, it is possible to measure the state of the user using an average value of the values measured by the same equipment of the smart watch 200 and the mobile terminal 300 or using the measured value from one of the devices 200 and 300 having a relatively higher performance.

Likewise, the user's state determination and the displayed color determination may be performed by either the smart watch 200 or the mobile terminal 300, or may be performed in both the smart watch 200 and the mobile terminal 300 and then compared. In the case that the state determination and the displayed color determination are performed in both the smart watch 400 and the mobile terminal 300, a re-determination procedure is performed or a priority is given to the determination of any one of the devices 300 and 400 so that the displayed color may be determined.

Further, when determining the displayed color, not only the smart watch 200, but also the terminal control unit 310 of the mobile terminal 300 may control to apply the displayed color to the terminal display unit 321 of the terminal output unit 320.

For this purpose, a camera, a microphone, an optical sensor (or an optical sensitivity sensor) may be configured in the respective input units 230 and 330 of the smart watch 200 and the mobile terminal 300, and sensors such as a pulse sensor, a temperature sensor, an acceleration sensor, a GPS sensor, a gyro sensor, and a blood pressure sensor may be configured in each of or divided into the respective sensor unit 240 and 340 thereof, but the present invention is not limited thereto. Further, a lookup table in which the segmented levels of the measurement targets, the reference values for determining the levels, the state combination, and the displayed color are determined may be stored in the storage unit 250 and 350 of the devices 200 and 300 that perform the user's state determination and the displayed color determination.

While the present invention has been particularly shown and described with reference to exemplary embodiments thereof, the present invention is not limited to the above-described embodiments, and various modifications may be made without departing from the scope of the present invention. Accordingly, such modifications are deemed to be within the scope of the present invention, and the scope of the present invention should be determined by the following claims.

INDUSTRIAL APPLICABILITY

The smart watch having the display changing in color according to the mood of a user in the present invention may measure the mood or state of the user using various methods and change the displayed color of the wearable auxiliary device according to the mood of the user, whereby it is possible to allow the user to express individuality via the smart watch and divert and improve the mood of the user through a change in color of the smart watch, thereby making it possible to be used as a terminal device for a health care service.

The invention claimed is:

1. A smart watch having a display changing in color according to a state of a user, the smart watch comprising:
   an output unit having a display unit;
   a sensor unit collecting state information for a measurement target associated with a user or around the user; and
   a control unit comparing the collected state information with state combination information stored in advance, selecting one piece of combination information that corresponds to the state information from among the state combination information, and controlling the output unit so as to output a displayed color matching the selected combination information,
   wherein the state combination information includes a plurality of pieces of state combination written by combining the segmented levels of the measurement targets, and the displayed color determined for each of the plurality of pieces of state combination.

2. The smart watch according to claim 1, wherein the sensor unit is configured to include at least one of a temperature sensor, a pulse sensor, a blood pressure sensor, an accelerator sensor, a GPS sensor, a gyro sensor, and an optical sensor;
   and an input device including a camera or a microphone.

3. The smart watch according to claim 1, wherein the displayed color is a screen color of the display unit output via the display unit in a standby status or a theme color of an icon or an image output via the display unit while a function is performed.

4. The smart watch according to claim 1, wherein the collected state information is provided such that a level thereof is determined according to segmented levels determined for each of the measurement targets, and the information for each of the measurement targets having the determined level is combined.

5. The smart watch according to claim 4, further comprising a storage unit, in which a reference value predetermined for each of the measurement targets is stored in the storage unit to determine the level according to the segmented levels, and the control unit compares the reference value with the state information to determine the level for the measured value of the measurement target.

6. The smart watch according to claim 1, wherein the control unit compares the state information obtained by combining the determined levels with the plurality of pieces of state information to search for the matching state combination, and controls the output unit to output a displayed color that is stored to correspond to the state combination found through the searching.

7. The smart watch according to claim 1, wherein the smart watch is configured to include an RF unit for performing communication with a mobile terminal of a master device, and performs a part of functions of the mobile terminal instead of the mobile terminal, and is worn on a user's body part.

8. The smart watch according to claim 7, wherein the state information is collected from at least one of the smart watch and the mobile terminal.

9. The smart watch according to claim 7, wherein the determination of the segmented level for the state information and the determination of the displayed color are performed by the smart watch or the mobile terminal.

10. The smart watch according to claim 7, wherein the mobile terminal controls an output unit thereof to output the determined displayed color.

* * * * *